US005830072A

United States Patent [19]

D'Aguiar

[11] Patent Number: 5,830,072

[45] Date of Patent: Nov. 3, 1998

[54] POOL TABLE

[75] Inventor: Michael J D'Aguiar, George, South Africa

[73] Assignee: League Pool Table Technology (Proprietary) Limited, Cape Town, South Africa

[21] Appl. No.: 740,000

[22] Filed: Oct. 30, 1996

[51] Int. Cl.[6] ..... A63D 15/00

[52] U.S. Cl. ..... 473/33; 473/29; 273/DIG. 7

[58] Field of Search ..... 473/9, 15, 16, 473/29, 33; 273/DIG. 7

[56] References Cited

U.S. PATENT DOCUMENTS

| | | | |
|---|---|---|---|
| 2,470,238 | 5/1949 | Correale et al. | 473/9 X |
| 3,263,996 | 8/1966 | Braun | 273/DIG. 7 |
| 3,319,958 | 5/1967 | Bender | 473/15 |
| 3,441,273 | 4/1969 | Woods | 473/15 |
| 4,229,004 | 10/1980 | Stokes | 473/29 X |
| 4,365,803 | 12/1982 | Barnes et al. | 473/16 X |

FOREIGN PATENT DOCUMENTS

| | | |
|---|---|---|
| 442504 | 3/1936 | United Kingdom . |

*Primary Examiner*—William E. Stoll
*Attorney, Agent, or Firm*—Darby & Darby

[57] ABSTRACT

The invention provides a pool table body made as a single integral moulding of reinforced synthetic resin material for supporting a covered slate bed providing the playing surface and a pool table including such a body. This construction facilitates construction and transport and enables coin operated mechanisms controlling the pool balls to be housed therein.

5 Claims, 1 Drawing Sheet

POOL TABLE

FIELD OF THE INVENTION

This invention relates to tables used for playing the games of pool, snooker, billiards and the like.

BACKGROUND OF THE INVENTION

Games of the above kind are popular but conventional tables made from wood are expensive or alternatively where made from wood of poorer quality subject to warping or damage resulting in a playing surface which is difficult to maintain true.

OBJECT OF THE INVENTION

The object of the present invention is to provide a pool table which is robust and suitable for public use.

SUMMARY OF THE INVENTION

According to this invention there is provided a pool table comprising a body moulded from suitable synthetic resin material in one piece and adapted to receive and support a cloth covered bed providing the playing surface.

Further features of this invention provide for the pool table to have a body as above defined with a cloth covered slate bed positioned thereon, for the peripheral cushions to be attached to the bed or to the body and for the bed to be inserted into the body from above.

The invention also provides for the body to be moulded from fibreglass reinforced synthetic resin and for the bed to be inserted through a slot provided in a side or end wall of the body. In this case rollers will preferably be mounted in the body to facilitate the insertion of the bed into the body.

BRIEF DESCRIPTION OP THE DRAWINGS

These and other features of this invention will become apparent from the following description of preferred embodiments of the invention described below. Reference is made to the accompanying drawings in which.

DETAILED DESCRIPTION OF THE INVENTION WITH REFERENCE TO THE DRAWINGS

As illustrated the pool table (1) has a body (2) which is moulded from glass fibre reinforced synthetic material using known techniques. The body (2) will be moulded and strengthened in known manner so that it will rigidly support a cloth covered bed (3) made from slate also in conventional manner.

The body is made in one piece, facilitates assembly of the table and permits a high production rate and reduced costs compared to conventional manufacture where the body has always been made in two parts These parts form a top and bottom which must be secured together with the slate bed between them.

Figure 2:
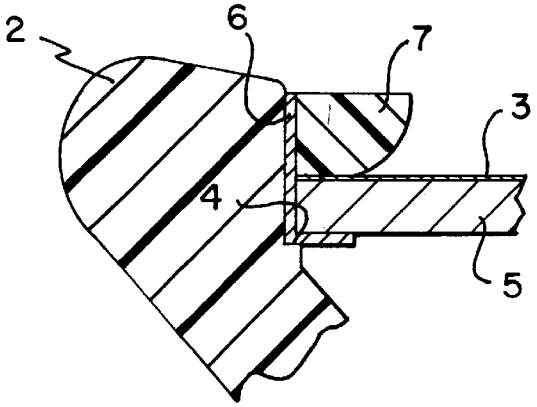
FIG. 2 shows a detail of the assembly.

Internally the body has a peripheral shelf (4) as indicated in FIG. 2. This shelf (4) enables a bed (5) of slate cloth covered to provide a playing surface.

Attached to the periphery of the bed (5) by means of suitable supporting clips (6) are the peripheral cushions (7) for the table.

This enables the bed (5) and cushions (7) to be lowered into the body from above to rest securely on the shelf (4). This again enables the bed to be quickly and accurately located in position.

The unitary body also enables the table to accommodate the internal mechanisms where the table is to be operated commercially. Ball grabbing and coin release mechanisms (not shown) are provided and unauthorised access to these mechanisms is substantially prevented.

Figure 1:
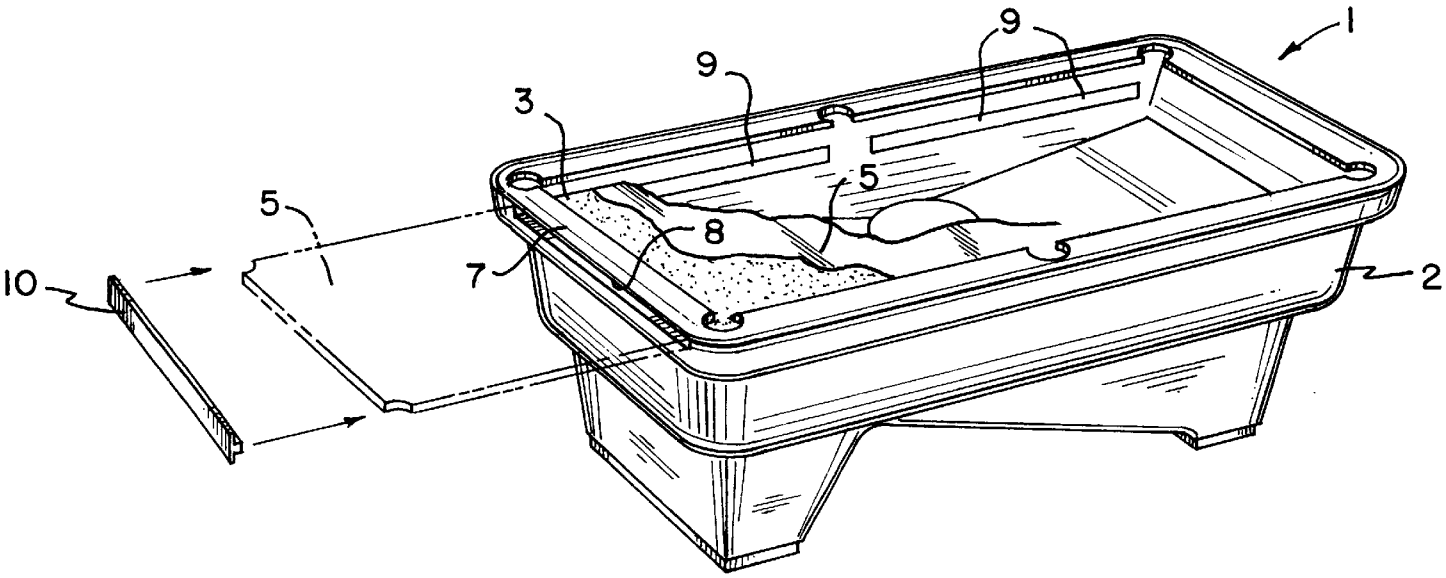
FIG. 1 is a perspective view of a pool table.

In an alternative arrangement also indicated in FIG. 1 the bed (5) may be introduced into the body through a slot (8) in one end or side of the body. Rollers (9) will be inserted in the body (2) on which the bed (3) can be moved into position and supported.

A slot closure strip (10) can be provided to close the slot and retain the bed accurately positioned in the body. This arrangement or the vertical lifting of the slate facilitates access to the coin operated mechanisms for maintenance or repair purposes.

The body will have adjustable feet fitted to the base in well known manner so that the playing surface can be accurately horizontally positioned.

It will also be understood that the unitary nature of the body lends itself to aesthetic variation. Further it enables the tables to be stackable which facilitates transportation.

I claim:

1. A pool table comprising:

a cloth covered slate bed; and a one-piece, unitary body made from a synthetic resin material, the body having walls which define a slot, and the cloth being received and supported by said body in the slot to define a playing surface.

2. The pool table as in claim 1, wherein the cloth covered slate bed rests on supports within the slots of the body.

3. The pool table as in claim 2, further comprising peripheral cushions attached to the walls of the body within the slot and above the cloth covered bed.

4. The pool table as in claim 1, wherein the body is moulded from glass fibre reinforced synthetic resin material.

5. The pool table as in claim 1, wherein the cloth covered bed is rigidly supported by the body.

* * * * *